US009462922B1

(12) United States Patent
Ko

(10) Patent No.: US 9,462,922 B1
(45) Date of Patent: Oct. 11, 2016

(54) SELF-MOVING DUST SUCTION DEVICE

(71) Applicant: Joseph Y. Ko, Laguna Niguel, CA (US)

(72) Inventor: Joseph Y. Ko, Laguna Niguel, CA (US)

( * ) Notice: Subject to any disclaimer, the term of this patent is extended or adjusted under 35 U.S.C. 154(b) by 0 days.

(21) Appl. No.: 14/735,847

(22) Filed: Jun. 10, 2015

(51) Int. Cl.
*A47L 9/28* (2006.01)
*A47L 11/40* (2006.01)
*A47L 9/00* (2006.01)

(52) U.S. Cl.
CPC ..... *A47L 11/4041* (2013.01); *A47L 9/009* (2013.01); *A47L 11/4058* (2013.01); *A47L 11/4052* (2013.01); *A47L 2201/00* (2013.01); *A47L 2201/02* (2013.01)

(58) Field of Classification Search
CPC ..... A47L 11/4041; A47L 11/4058; A47L 11/18; A47L 11/185; A47L 9/009; A47L 2201/00; A47L 11/4052
USPC ..... 15/319
IPC ..... A47L 9/28
See application file for complete search history.

(56) References Cited

U.S. PATENT DOCUMENTS 2,166,977 A * 7/1939 Smith ..... A47L 11/33 15/41.1
6,550,089 B1 * 4/2003 Ussen ..... A47L 13/38 15/3
2002/0002751 A1 * 1/2002 Fisher ..... A47L 11/03 15/98
2012/0304405 A1 * 12/2012 Knopow ..... A47L 11/4013 15/104.002

* cited by examiner

*Primary Examiner* — David Redding
(74) *Attorney, Agent, or Firm* — Muncy, Geissler, Olds & Lowe, P.C.

(57) ABSTRACT

A self-moving dust suction device comprises a body, at least one buffer means and a sticking means. The body includes a top cover, a base, a dust suction operation module, at least two movement wheels and at least one mounting portion. The buffer means is corresponding to the mounting portion and has an installation dock fastened to the mounting portion, a buffer element located on the installation dock to provide an action force in a direction remote from the top cover in normal conditions and a butting dock located at one end of the buffer element remote from the top cover to bear the action force. The sticking means is located at one side of the base and has a connection bracket coupled with the butting dock to receive the action force transmitted by the butting dock and a sticking roller located on the connection bracket.

12 Claims, 5 Drawing Sheets

SELF-MOVING DUST SUCTION DEVICE

FIELD OF THE INVENTION

The present invention relates to a self-moving dust suction device and particularly to a self-moving dust suction device that also performs dust sticking while executing dust suction operation.

BACKGROUND OF THE INVENTION

With advance of technology nowadays many types of cleaning devices also are built with automation and intelligence capability. Most families also prefer to purchase multi-functional cleaning devices. Dust suction device is the most commonly seen household cleaning device. However, the conventional dust suction device generally is bulky in size and difficult for storing. Moreover, it usually generates very high decibel noises during dust suction operation. To resolve these problems automatic dust suction devices (such as iROBOT) have been developed and marketed. iROBOT is compact in size and can function without human control, hence can overcome the aforesaid problems. But while the conventional iROBOT can suck the dust, due to its design limitation it has difficulty to suck fine hairs or other small particles. To address this concern, a remote control dust suction device has been proposed that includes a flat disk, a roller means and a remote control means. The roller means has a sticking roller at the bottom of the flat disk. When a drive means of the remote control dust suction device is activated and the remote control dust suction device moves to do dust suction operation the sticking roller touches the floor surface at the same time to stick hairs on the floor. However, when the remote dust suction device moves on uneven floor surface the sticking roller cannot adjust to suit the uneven floor surface, hence operation of the remote control dust device is affected or cleaning task is incompletely executed.

SUMMARY OF THE INVENTION

The primary object of the present invention is to solve the problem of the conventional self-moving dust suction devices equipped with a sticking roller which is not adjustable with the uneven floor surface.

To achieve the foregoing object the present invention provides a self-moving dust suction device that comprises a body, at least one buffer means and a sticking means. The body includes a top cover, a base coupled with the top cover to jointly define a housing space, a dust suction operation module located on the base and held in the housing space, at least two movement wheels located on the base and driven by the dust suction operation module and at least one mounting portion located at one side of the base remote from the top cover. Each buffer means is corresponding to the mounting portion and has an installation dock fastened to the mounting portion, a buffer element located on the installation dock to provide an action force in a direction remote from the top cover in normal conditions and a butting dock located at one end of the buffer element remote from the top cover to bear the action force. The sticking means is located at one side of the body corresponding to the base and has a connection bracket to receive the action force transmitted by the butting dock and a sticking roller located on the connection bracket.

In one embodiment the base has a first assembly portion close to the mounting portion to fasten the installation dock.

In another embodiment the installation dock includes a seat, an assembly space formed on the seat for assembly of the buffer element and a second assembly portion located on an edge of the seat corresponding to the first assembly portion.

In yet another embodiment the butting dock includes a baseboard corresponding to the installation dock and in contact with the buffer element to receive the action force in the normal conditions, and an assembly strut located on the baseboard and extended toward the installation dock to couple with the buffer element and fasten to the installation dock.

In yet another embodiment the installation dock has a track located on the seat and communicating with the assembly space, and the buffer dock has a rib corresponding to the track to confine movement amplitude of the butting dock.

In yet another embodiment the connection bracket has a rack for assembly of the sticking roller and at least one installation portion located on the rack and facing the base to couple with the installation dock.

In yet another embodiment the rack includes a connection portion for installation of the sticking roller and a dust barrier extended from the connection portion to partially cover the sticking roller. The installation portion includes at least two spaced assembly walls to jointly define a buffer gap. The assembly space has an inner diameter. The installation portion has an outer diameter greater than the inner diameter.

In yet another embodiment the body is a circular disk.

In yet another embodiment the buffer means has a fastener fastened to the installation dock, moreover, the fastener is a screw.

The invention, by means of the structure set forth above, compared with the conventional structures, provides many advantageous features, notably:

Through a buffer means an action force is provided in normal conditions to the sticking means so that the sticking means is in contact with the floor surface in the normal conditions. In the event that the floor surface is uneven the buffer element in the buffer means allows the sticking means to squeeze the buffer element in a suitable manner so that the sticking means can also respond the uneven condition of the floor surface, thereby the sticking means can make suitable adjustment according to the uneven floor surface to avoid the problem of incomplete dust suction that might otherwise occur.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENT

Figure 1:
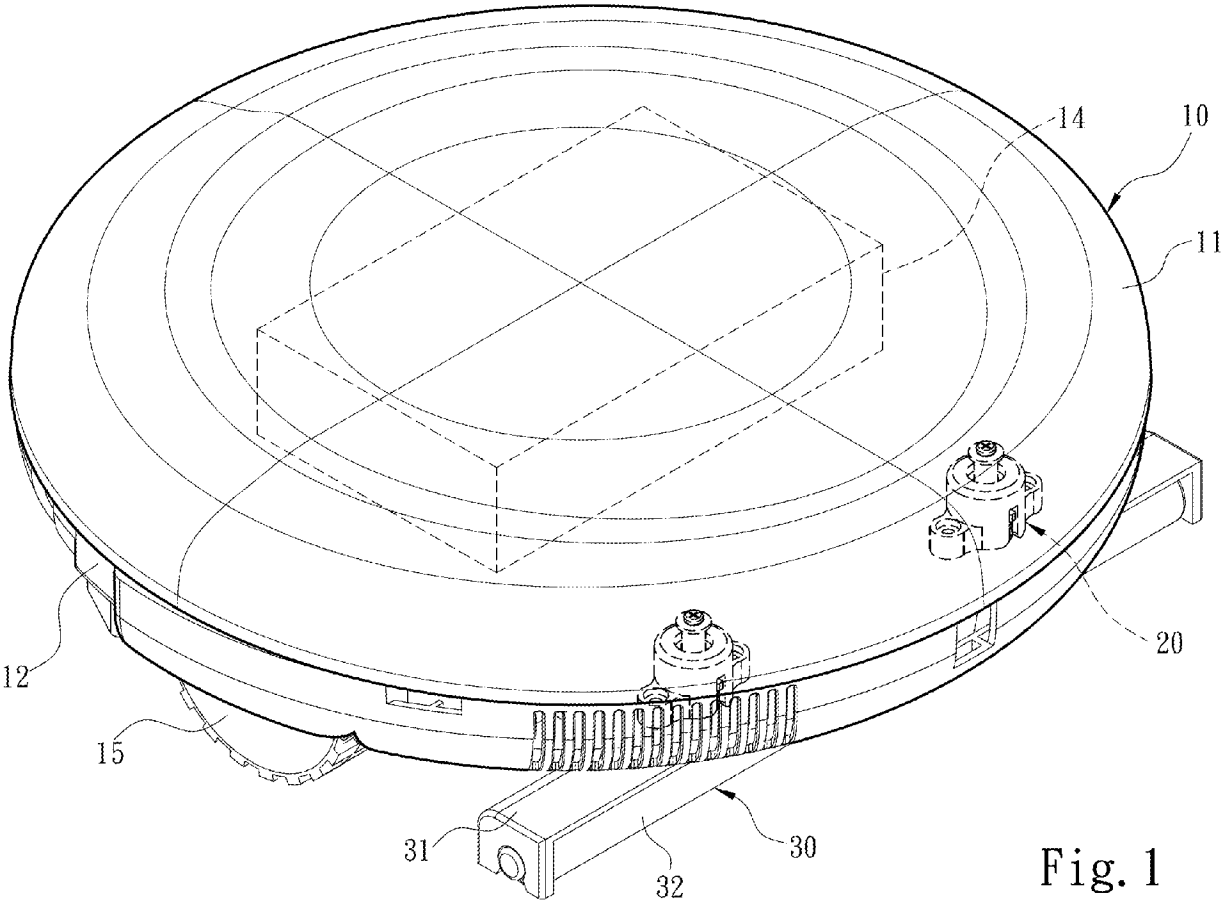
FIG. 1 is a perspective view of an embodiment of the invention.
Figure 2:
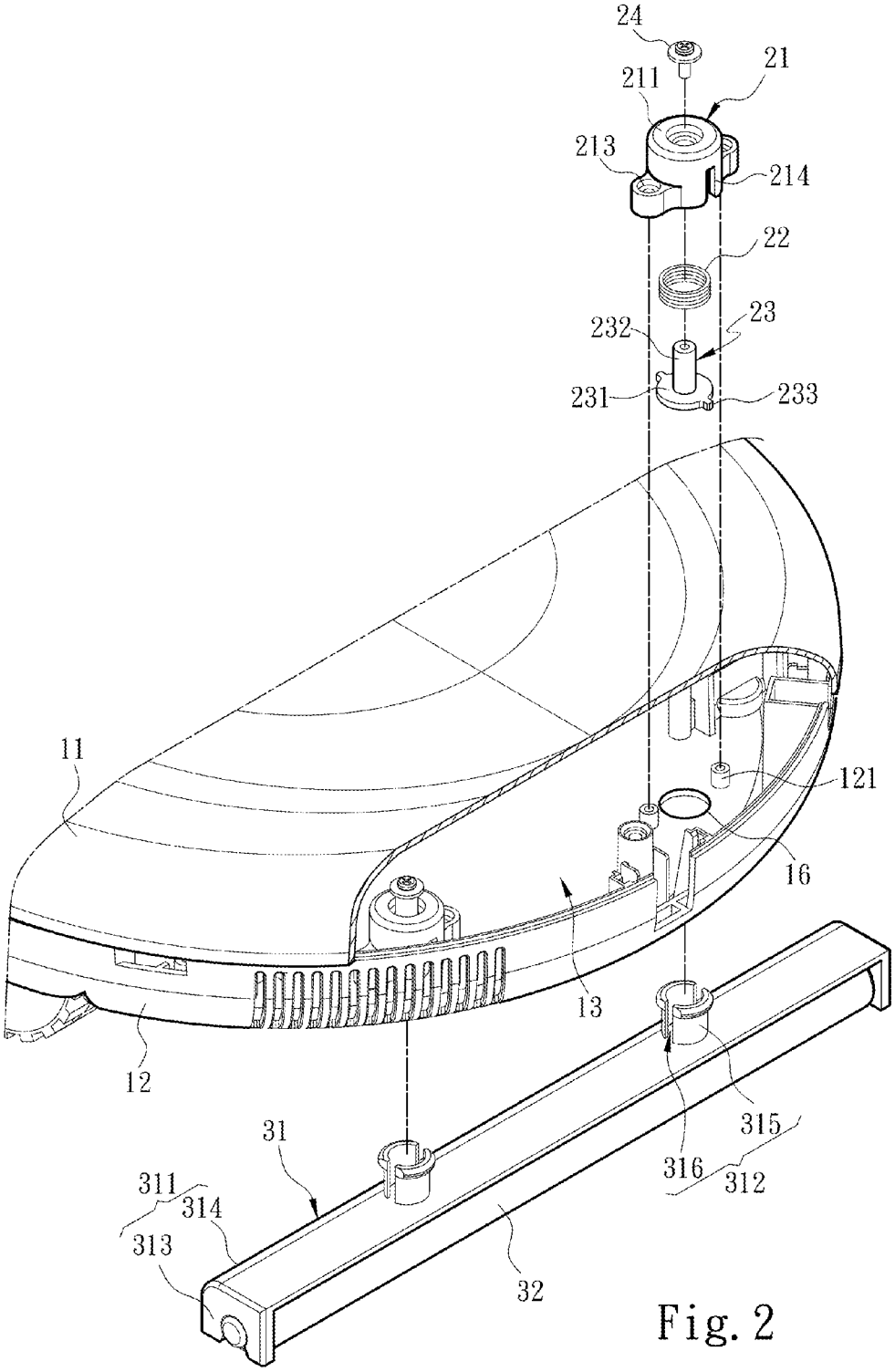
FIG. 2 is an exploded view of an embodiment of the invention.

Please referring to FIGS. 1 and 2, the present invention aims to provide a self-moving dust suction device that comprises a body 10, at least one buffer means 20 corresponding to the body 10 and a sticking means 30 located on the body 10. The body 10 can be made and adjusted according to implementation requirements, such as, but not limited to, a circular disk. The body 10 includes a top cover 11, a base 12 coupled with the top cover 11 to jointly define a housing space 13, a dust suction operation module 14 located on the base 12 and held in the housing space 13, at least two movement wheels 15 located on the base 12 and driven by the dust suction operation module 14 and at least one mounting portion 16 located at one side of the base 12 remote from the top cover 11. Furthermore, the top cover 11 is made in a shape and size mating the base 12 for coupling therewith to jointly form the housing space 13. In addition, the dust suction operation module 14 can be driven and moved to do dust suction operation. In one embodiment the dust suction operation module 14 includes a dust suction portion, a power drive portion, a power storage portion and a dust collection portion. The power drive portion gets operation power from the power storage portion that is needed to perform dust suction operation and move. After the power drive portion is activated, aside from making the dust suction portion to perform dust suction operation, it also drives the movement wheels 15 to rotate. Dust gathered by the dust suction portion during the dust suction operation is temporarily held in the dust collection portion. In addition, in one embodiment of the invention, each mounting portion 16 can be a recess located at one side of the base 12 remote from the top cover 11 or an aperture run through the base 12. In the embodiment, in order to facilitate discussion, the mounting portion 16 is assumed running through the base 12, as shown in FIG. 2.

Please referring to FIGS. 1 and 2 again, the buffer means 20 is made corresponding to each mounting portion 16, namely, each buffer means 20 is installed on one corresponding mounting portion 16. Each buffer means 20 also is connected to the sticking means 30, and includes an installation dock 21 fastened to the mounting portion 16, a buffer element 22 located on the installation dock 21 to provide an action force in a direction remote from the top cover 11 in normal conditions, and a butting dock 23 located at one end of the buffer element 22 remote from the top cover 11 to bear the action force in the normal conditions. In one embodiment the buffer means 20 is assembled in an order such as, from the top cover 11 toward the base 12, the installation dock 21, the buffer element 22 and the butting dock 23. The installation dock 21 is fastened to one end of the base 12 to make the buffer element 22 to provide the action force in the direction remote from the top cover 11. The butting dock 23 received the action force transmits the action force to the sticking means 30 so that during the self-moving dust suction device is performing dust suction operation the sticking means 30 touches floor surface in the normal conditions. The buffer element 22 can be an elastic element such as a spring, an elastic pad or the like.

Also referring to FIGS. 1 and 2, the sticking means 30 is located at one side of the body 10 corresponding to the base 12, and includes a connection bracket 31 connected to the butting dock 23 to receive the action force transmitted thereof and a sticking roller 32 located on the connection bracket 31. Furthermore, while the self-moving dust suction device is in use to perform dust suction operation the sticking roller 32 rolls with movement of the body 10 to stick hairs or fine dust on the floor surface. Moreover, the connection bracket 31 receives the action force transmitted from the butting dock 23 in the normal conditions so that the sticking roller 32 is pushed to touch the floor surface.

Figure 3:
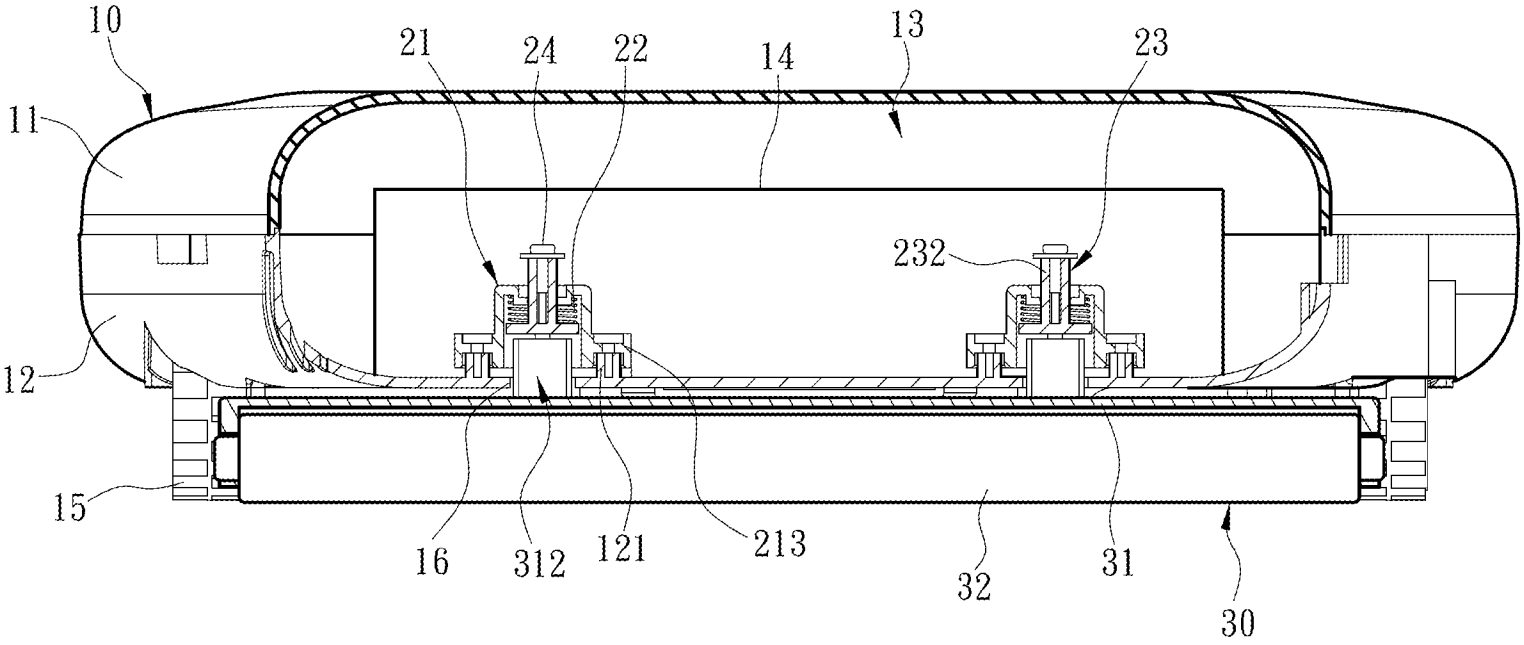
FIG. 3 is a fragmentary sectional view of an embodiment of the invention.

Please referring to FIGS. 2 and 3, in one embodiment of the invention the base 12 further includes a first assembly portion 121 close to the mounting portion 16 for fastening the installation dock 21. Moreover, the installation dock 21 has a seat 211, an assembly space 212 formed on the seat 211 for installation of the buffer element 22 and a second assembly portion 213 at one edge of the seat 211 to mate the first assembly portion 121 for installation thereof. Furthermore, for installation of the buffer means 20 on the mounting portion 16, first, assemble the second assembly portion 213 of the installation dock 21 with the first assembly portion 121 so that the installation dock 21 is corresponding to the mounting portion 16 and fastened to the base 12. More specifically, the first assembly portion 121 and the second assembly portion 213 can be a snap coupling structure, a bolt structure or other fastening structure.

Please referring to FIGS. 2 and 3, the butting dock 23 includes a baseboard 231 corresponding to the installation dock 21 in contact with the buffer element 22 to receive the action force in the normal conditions and an assembly strut 232 located on the baseboard 231 and extended toward the installation dock 21 to couple with the buffer element 22 and confine the butting dock 23 on the installation dock 21 to be movable up and down thereon. More specifically, the assembly strut 232 runs through the seat 211 to form confining relationship therewith, and when the self-moving dust suction device is moving on an uneven floor surface the butting dock 23 receives action from the sticking means 30 and moves vertically and reciprocally against the seat 211. In addition, the assembly strut 232 can be positioned at the substantial center of the baseboard 231 so that the action force provided by the buffer element 22 can be evenly distributed to the baseboard 231. Moreover, the buffer means 20 has a fastener 24 fastened to the assembly strut 232 to confine the assembly strut 232 to the installation dock 21, and the assembly strut 232 can be moved properly against the installation dock 21. In one embodiment the fastener 24 can be, but not limited to, a screw, a tenon or other fastenable structure.

The installation dock 21 can further include a track 214 on the seat 211 connected to the assembly space 212. The butting dock 23 has a rib 233 corresponding to the track 214 to confine movement amplitude of the butting dock 23. More specifically, the track 214 can be formed on a side wall of the seat 211 and extended toward the top cover 11; in other words, the track 214 has a release end at one side facing the base 12, and a closed end at another side facing the top cover 11. The rib 233 of the butting dock 23 can be installed in the track 214 through the release end and is movable as desired against the track 214.

Figure 4A:
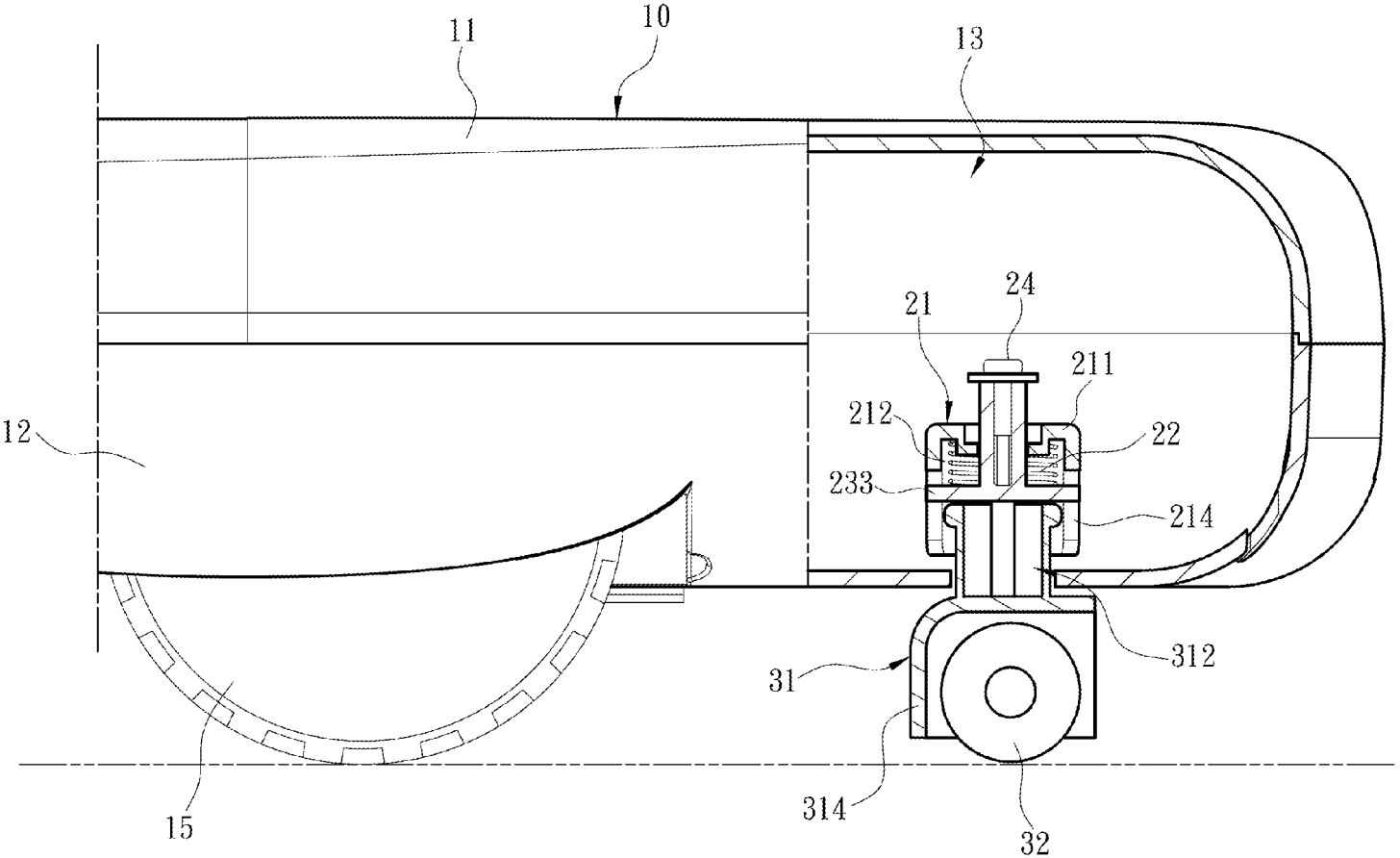
FIG. 4A is a schematic view of an embodiment of the invention showing an operation condition.

Please referring to FIGS. 2 and 4A, the connection bracket 31 of the sticking means 30 has a rack 311 for installation of the sticking roller 32 and at least one installation portion 312 located on the rack 311 and faced the base 12 to couple with the installation dock 21. The rack 311 includes a connection portion 313 for installation of the sticking roller 32 and a dust barrier 314 extended from the connection portion 313 to partially cover the sticking roller 32. More specifically, the dust barrier 314 can block the dust raised during movement of the self-moving dust suction device.

In addition, the installation portion 312 includes at least two spaced assembly walls 315 that jointly define a buffer gap 316. Moreover, the assembly space 212 has an inner diameter, while the installation portion 312 has an outer diameter greater than the inner diameter. More specifically, at the initial stage of coupling the installation portion 312 on the installation dock 21, with the outer diameter of the installation portion 312 greater than the inner diameter of the assembly space 212, the installation portion 312 is squeezed during the assembly process and each assembly wall 315 also is compressed toward the buffer gap 316, finally the installation portion 312 is installed in the assembly space 212 with each assembly wall 315 returned to the original condition without receiving the force, thus can butt the inner wall of the assembly space 212 so that the installation portion 312 can latch in the assembly space 212.

Figure 4B:
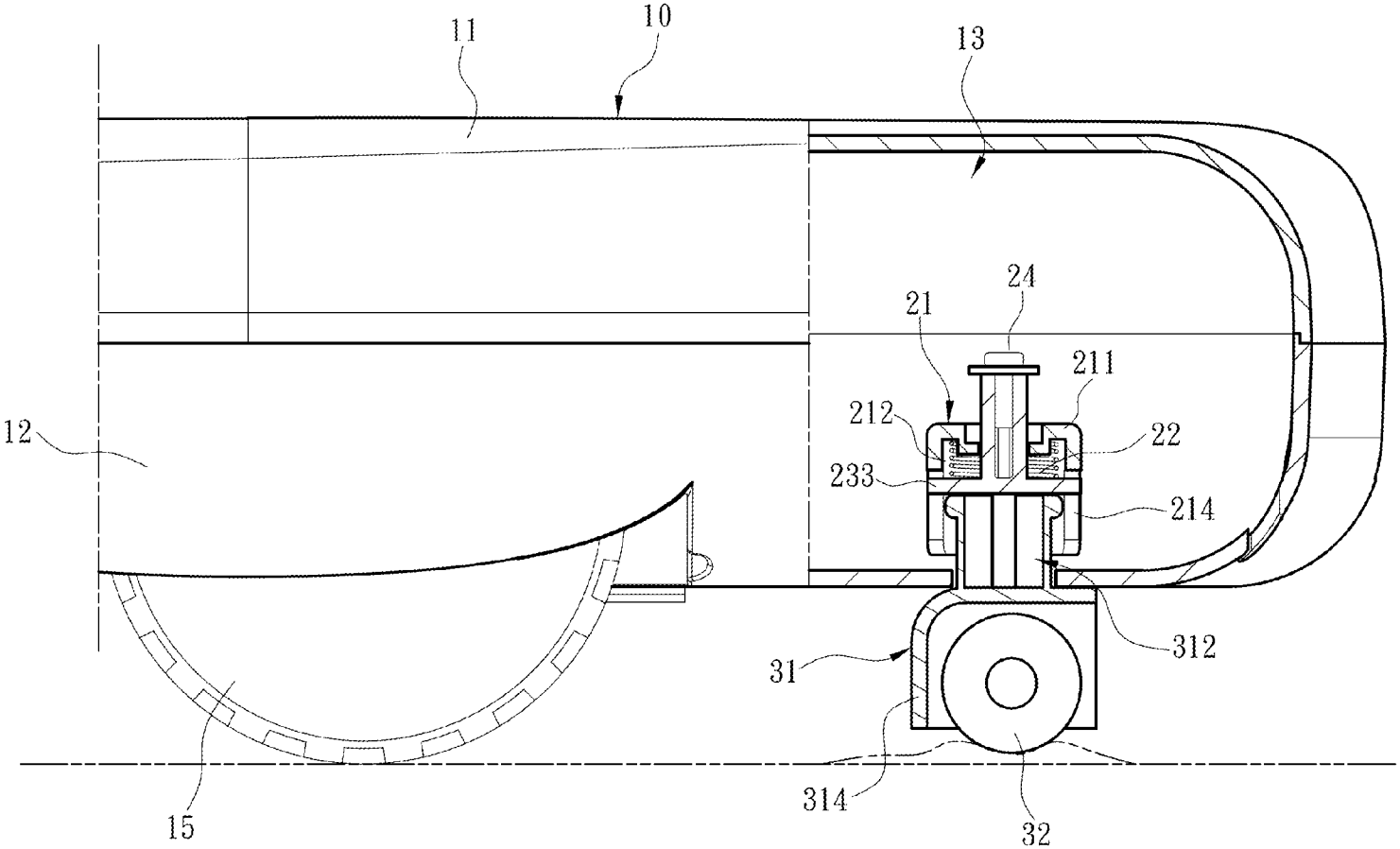
FIG. 4B is a schematic view of an embodiment of the invention showing another operation condition.

Please refer to FIGS. 3, 4A and 4B for actual implementation of the self-moving dust suction device of the invention.

Initially, the self-moving dust suction device is placed on a floor surface, the buffer means 20 provides the action force to make the sticking means 30 in contact with the floor surface in normal conditions as shown in FIG. 4A. When the self-moving dust suction device is activated to perform dust suction operation, it moves on the floor surface. In the event that the floor surface is uneven, the sticking roller 32 of the sticking means 30 moves toward the base 12 of the body 10 due to the uneven floor surface; meanwhile, the installation portion 312 pushes the butting dock 23 to move in the same direction to compress the buffer element 22, therefore the sticking means can adjust properly with the uneven floor surface and generate buffer function as shown in FIG. 4B. After the self-moving dust suction device has moved away from the uneven floor surface the buffer element 22 loses the compressed action force and returns to the state in the normal conditions, and provides the action force again, and the butting dock 23 receives the action force and transmits the action force to the connection bracket 31 of the sticking means 30; the connection bracket 31, through the action force and its own gravity, makes the sticking means 30 to touch the floor surface again.

As a conclusion, the self-moving dust suction device of the invention includes a body, at least one buffer means and a sticking means. The body includes a top cover, a base coupled with the top cover to jointly form a housing space, a dust suction operation module located on the base and held in the housing space, at least two movement wheels located on the base and driven by the dust suction operation module, and at least one mounting portion at one side of the base remote from the top cover. Each buffer means is corresponding to the mounting portion, and includes an installation dock fastened to the mounting portion, a buffer element located on the installation dock to provide an action force in a direction remote from the top cover in normal conditions, and a butting dock located at one end of the buffer element remote from the top cover to bear the action force. The sticking means is located at one side of the body corresponding to the base and includes a connection bracket connected to the butting dock to receive the action force transmitted by the butting dock, and a sticking roller located on the connection bracket. The buffer element on the installation dock provides the action force in the direction remote from the top cover in the normal conditions, and the action force butts the butting portion and is transmitted via the installation dock to the connection bracket so that the sticking roller can be moved in the direction remote from the top cover in the normal conditions to stick hairs, thereby solve the problem of the conventional self-moving dust suction device moving on uneven floor surface by enabling the sticking roller to make proper adjustment while moving on the uneven floor surface so that the sticking roller can touch the floor surface in the normal conditions to avoid the problem of incomplete sweeping.

What is claimed is:

1. A self-moving dust suction device, comprising:

a body including a top cover, a base coupled with the top cover to jointly form a housing space, a dust suction operation module located on the base and held in the housing space, at least two movement wheels located on the base and driven by the dust suction operation module and at least one mounting portion located at one side of the base remote from the top cover;

at least one buffer means which corresponds to the mounting portion and includes an installation dock fastened to the mounting portion, a buffer element located on the installation dock to provide an action force in normal conditions in a direction remote from the top cover, and a butting dock located at one end of the buffer element remote from the top cover to bear the action force in the normal conditions; and a sticking means which is located at one side of the body corresponding to the base and includes a connection bracket coupled on the butting dock to receive the action force transmitted by the butting dock and a sticking roller located on the connection bracket.

2. The self-moving dust suction device of claim 1, wherein the base comprises a first assembly portion abutting the mounting portion for fastening of the installation dock.

3. The self-moving dust suction device of claim 1, wherein the installation dock includes a seat, an assembly space formed on the seat for assembly of the buffer element and a second assembly portion at one edge of the seat corresponding to the first assembly portion for installation thereof.

4. The self-moving dust suction device of claim 3, wherein the butting dock includes a baseboard corresponding to the installation dock in contact with the buffer element to receive the action force in the normal conditions and an assembly strut located on the baseboard and extended toward the installation dock to couple with the buffer element and confine the butting dock on the installation dock to be movable up and down thereof.

5. The self-moving dust suction device of claim 3, wherein the installation dock includes a track located on the seat and communicating with the assembly space, the butting dock including a rib corresponding to the track to confine movement amplitude of the butting dock.

6. The self-moving dust suction device of claim 3, wherein the connection bracket includes a rack for assembly of the sticking roller and at least one installation portion located on the rack and faced the base to couple with the installation dock.

7. The self-moving dust suction device of claim 6, wherein the rack includes a connection portion for installation of the sticking roller and a dust barrier extended from the connection portion to partially cover the sticking roller.

8. The self-moving dust suction device of claim 6, wherein the installation portion includes at least two spaced assembly walls which jointly form a buffer gap.

9. The self-moving dust suction device of claim 7, wherein the assembly space has an inner diameter, and the installation portion has an outer diameter greater than the inner diameter.

10. The self-moving dust suction device of claim 7, wherein the body is a circular disk.

11. The self-moving dust suction device of claim 1, wherein the buffer means comprises a fastener fastened to the installation dock.

12. The self-moving dust suction device of claim 11, wherein the fastener is a screw.

* * * * *